US005409142A

United States Patent [19]

Wenmaekers et al.

[11] Patent Number: 5,409,142

[45] Date of Patent: Apr. 25, 1995

[54] DISMANTLEABLE SUBSTANCE DISPENSER DEVICE

[76] Inventors: Monique Wenmaekers, 22 bis avenue de Suffren, 75015 Paris; Edmond Wenmaekers, 30 chemin des Murets, 78930 Goussonville, both of France

[21] Appl. No.: 123,675

[22] Filed: Sep. 20, 1993

[30] Foreign Application Priority Data

Sep. 21, 1992 [FR] France ..... 92 11200

[51] Int. Cl.[6] ..... B65D 83/38

[52] U.S. Cl. ..... 222/95; 222/386.5

[58] Field of Search ..... 222/95, 105, 94, 103, 222/386.5, 386, 211, 212

[56] References Cited

U.S. PATENT DOCUMENTS

| | | | |
|---|---|---|---|
| 3,738,538 | 6/1973 | Roper et al. | 222/386.5 X |
| 3,796,356 | 3/1974 | Venus, Jr. | 222/386.5 |
| 3,961,725 | 6/1976 | Clark | 222/212 X |
| 4,121,737 | 10/1978 | Kain | 222/95 |
| 4,953,753 | 9/1990 | Gortz | 222/212 X |
| 4,981,238 | 1/1991 | Wenmaekers | 222/95 X |
| 5,139,168 | 8/1992 | Gueret | 222/105 X |

FOREIGN PATENT DOCUMENTS

| | | | |
|---|---|---|---|
| 0222319 | 5/1987 | European Pat. Off. . | |
| 0300886 | 1/1989 | European Pat. Off. | 222/95 |
| 7204657 | 10/1972 | France . | |
| 404031279 | 2/1992 | Japan | 222/95 |
| 2115494A | 9/1983 | United Kingdom . | |

*Primary Examiner*—Andres Kashnikow
*Assistant Examiner*—Anthoula Pomrening
*Attorney, Agent, or Firm*—Nixon & Vanderhye

[57] ABSTRACT

A dispenser device comprises a container body having two axial ends. A receptacle made from an elastic material is placed in the container body and contains the substance to be dispensed. A dispensing head provided at a first axial end of the container body communicates with the receptacle and can be opened and closed on command. The dispenser device further includes a bottom base provided at the second axial end of the container body which is opposite the dispensing head and to which the receptacle is fixed. An elongation limiter is fixed to the dispensing head and to the bottom base to limit the separation between the dispensing head and the bottom base.

27 Claims, 4 Drawing Sheets

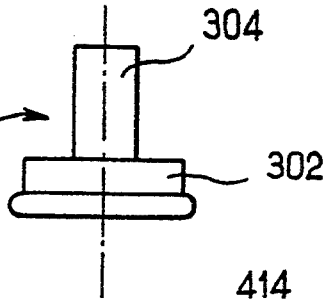
FIG. 3
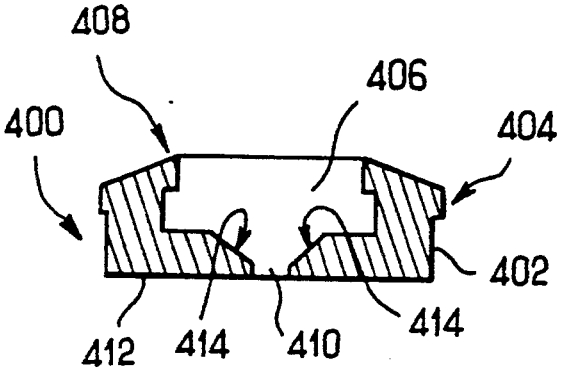
FIG. 4
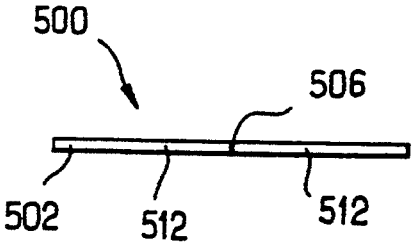
FIG. 6
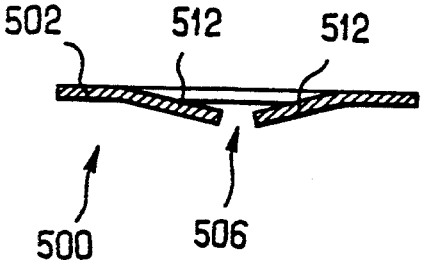
FIG. 7
FIG. 5
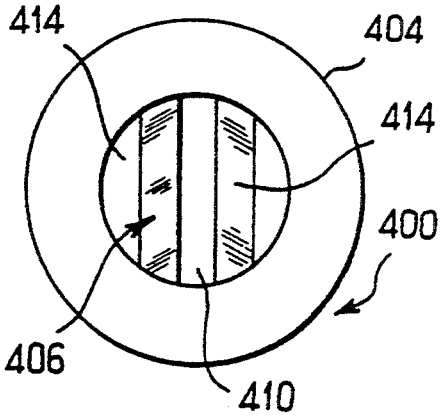
FIG. 8
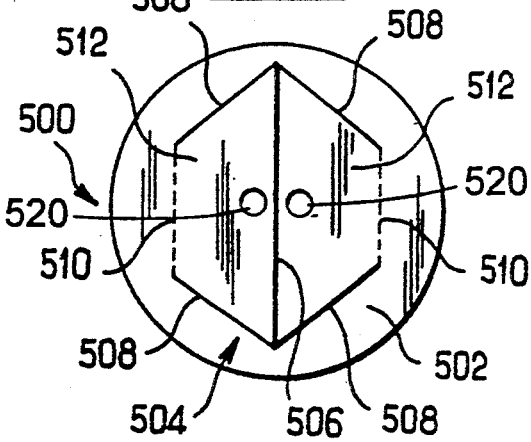
FIG. 9
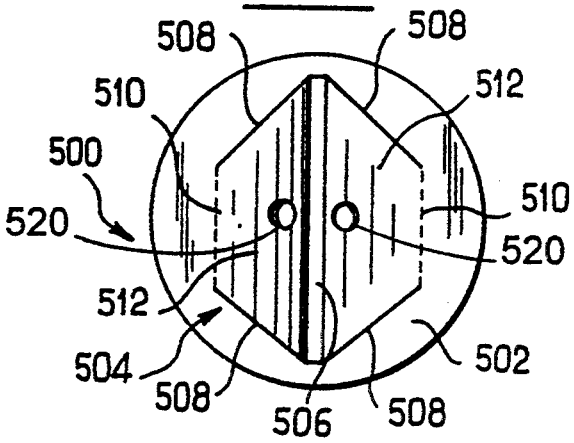

DISMANTLEABLE SUBSTANCE DISPENSER DEVICE

BACKGROUND OF THE INVENTION

1. Field of the Invention

The present invention relates to the field of dispenser devices for substances such as aerosols or viscous materials.

2. Discussion of Prior Art

Numerous dispenser devices have already been proposed for this purpose.

In particular, numerous dispenser devices have been proposed containing a volume of propellant gas based on fluorocarbon compounds. It is however known that these devices are tending to be abandoned nowadays because of the presumed interactions between the environment, especially ozone, and these fluorocarbon compounds.

In order to avoid employing these fluorocarbon compounds, it has also been proposed to use substitute gases such as nitrogen, compressed air and especially butane. These various solutions do not always prove satisfactory.

Dispensers comprising elastic propellant means have furthermore been proposed.

In particular, the document EP-A-0 300 886 proposes dispensers comprising a container body, a receptacle made from a flexible material and which contains the substance to be dispensed, a dispensing head which can be opened or closed on command, and elastic means formed from two elastic plates placed respectively on either side of the receptacle, in order to exert permanent pressure on the latter and allow the dispensing of the said substance only when the dispensing head is opened on command.

The document EP-A-0 388 270 describes enhancements to the dispenser proposed in the aforesaid document EP-A-0 300 886. According to these enhancements, the elastic means furthermore comprise an elastic sheath stretched over the said plates.

A dispenser in accordance with the document EP-A-0 388 270 has been represented in the attached FIGS. 1 and 2. More precisely, FIG. 1 represents an axial sectional view of an empty dispenser, whilst FIG. 2 represents an axial sectional view of the same dispenser when full. In FIGS. 1 and 2 may be observed:

- a container body 1, formed for example from a standard tinplate housing,
- a receptacle 2 consisting of a pouch made from flexible material, preferably elastic, typically made from butyl rubber, which contains the substance to be dispensed,
- a dispensing head 3 which communicates with the receptacle and which can be opened or closed on command,
- a dome 4 fixed to the dispensing head 3, preferably by flanging, in order to ensure the leaktightness of the receptacle 2 and fixed to the container body 1, preferably by seaming, in order to support the said dispensing head 3,
- a bottom 5 fixed to the container body 1,
- and elastic means formed
  - from two elastic plates 6, 7 placed respectively on either side of the receptacle 2, and
  - from an elastic sheath 8 stretched over the said plates 6, 7 in order to exert permanent pressure on the receptacle 2 and allow the dispensing of the said substance only when the dispensing head 3 is opened on command.

The dispenser devices of the type represented in FIGS. 1 and 2 attached turn out to be very promising. However, they are sometimes subject to certain criticism. Indeed, nowadays the problems of the ozone layer are controversial, whilst those of the piling up of waste and its recycling or destruction have become very tangible and predominant realities with respect to ecology.

Again, in this respect the known dispenser devices of the type represented in FIGS. 1 and 2 attached do not prove completely satisfactory. Indeed, the high pressures involved necessitate an assembly of the dome 4 to the dispensing head 3 and to the container body 1 which prohibits any dismantling of the dispenser.

As indicated earlier, the dome 4 is generally seamed to the container body 1, when these elements are metallic. If appropriate, the dome 4 may be welded or bonded to the container body 1 when these elements are made from plastic or glass. These various techniques of assembly prohibit any dismantling.

It has been envisaged to assemble the dome 4 to the container body 1 with the aid of a threading. However, it turns out that the pressures involved would require a threading with large pitch which is incompatible with the container body thickness involved. Moreover, making threading appreciably complicates the production tooling and reduces productivity, both at the level of the preparation of parts and assembly and necessitates the use of an axisymmetric container body.

SUMMARY OF THE INVENTION

The object of the present invention is now to enhance the existing dispenser devices.

An important object of the present invention is to propose a novel, readily dismantleable dispenser.

Another important object of the present invention is to propose a novel dispenser which can be refilled.

These objects are achieved according to the present invention, by virtue of a dispenser device which comprises:

- a container body,
- a receptacle made from an elastic material and which contains the substance to be dispensed, and
- a dispensing head which communicates with the receptacle and which can be opened or closed on command, characterized in that it furthermore comprises:
- a bottom wall provided at the axial end of the container body which is opposite the dispensing head and to which the receptacle is fixed,
- an elongation limiter fixed, on the one hand, to the dispensing head, and on the other hand, to the bottom wall, in order to limit the separation between them and
- a radial expansion limiter for the receptacle.

As will be understood from what follows, the dispenser device thus formed in accordance with the present invention can be readily dismantled owing to the fact that the unit formed by the receptacle, dispensing head, bottom wall and elongation limiter constitutes an insert which can be readily separated from the container body.

BRIEF DESCRIPTION OF THE DRAWINGS

Other characteristics, objects and advantages of the present invention will emerge on reading the detailed description which will follow in connection with the attached drawings, given by way of non-limiting examples and in which:

FIG. 3 represents a diagrammatic side view of a dispensing head,

FIG. 4 represents an axial sectional view of a dome,

FIG. 5 represents a plan view of the same dome,

FIG. 6 represents a first axial sectional view of a bottom wall in accordance with the present invention, FIG. 7 represents a second axial sectional view of the same bottom wall in accordance with the present invention after the latter is deformed so as to fix the receptacle, FIG. 8 represents a first plan view of the bottom wall, corresponding to FIG. 6, FIG. 9 represents a second plan view of the bottom wall, corresponding to FIG. 7.

DETAILED DISCUSSION OF PREFERRED EMBODIMENTS

Figure 1:
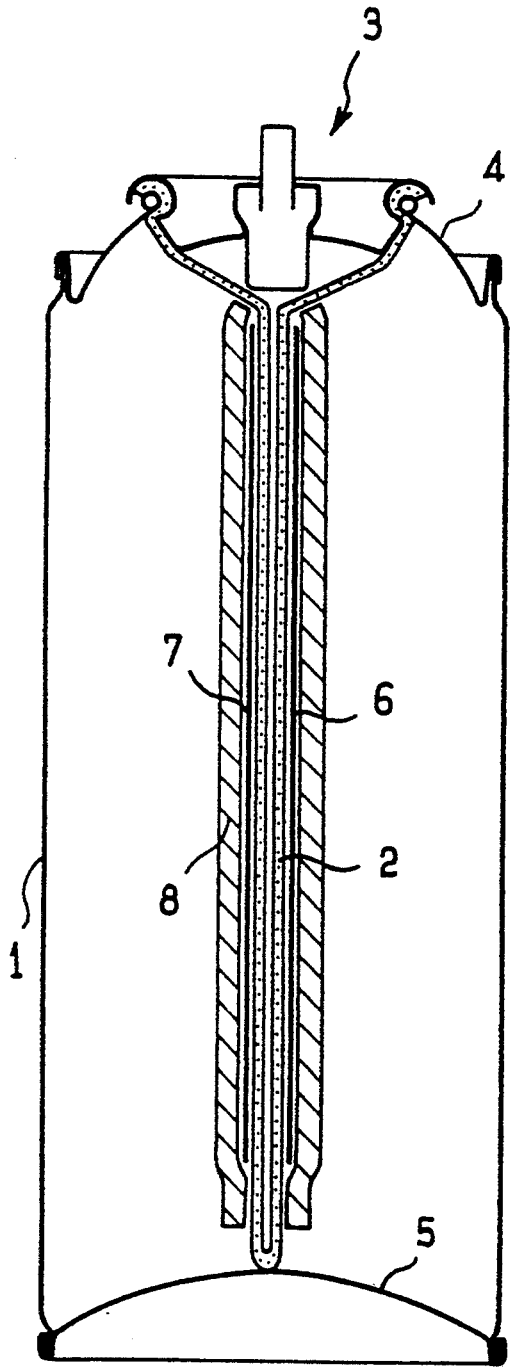
FIG 1 PRIOR ART
FIGS. 1 and 2 described earlier represent the state of the art.
Figure 2:
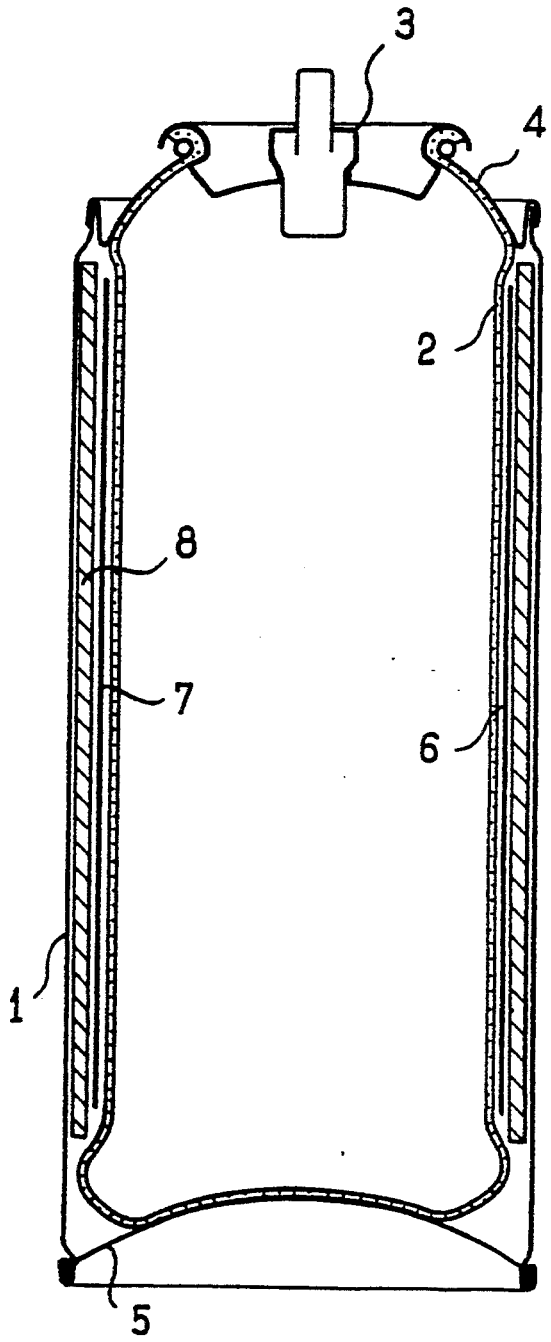
FIG 2 PRIOR ART

The dispenser device in accordance with the present invention, represented in the attached figures, comprises: a container body 100, a receptacle 200, a dispensing head 300, a dome 400, a bottom wall 500, two elastic plates 600 and 700, an elongation limiter 800 and an elastic sheath 900.

Figure 13:
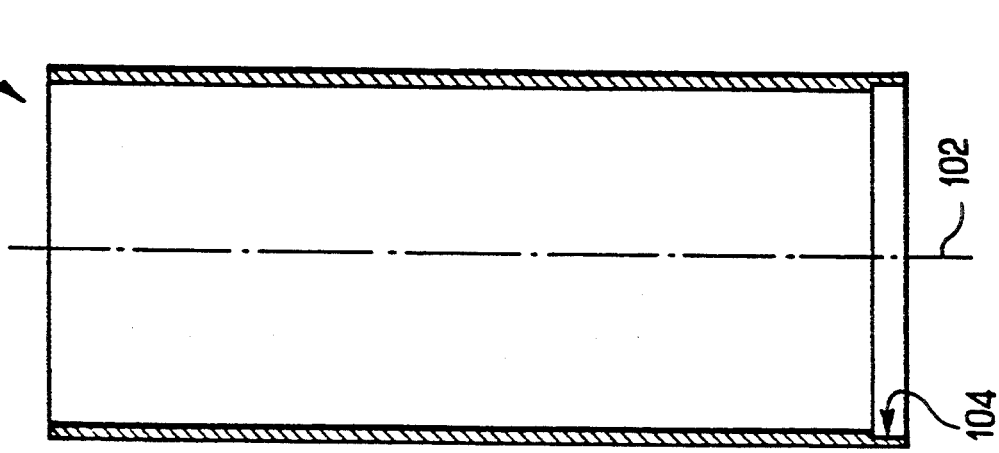
FIG. 13 represents an axial sectional view of container body in accordance with the present invention.
Figure 15:
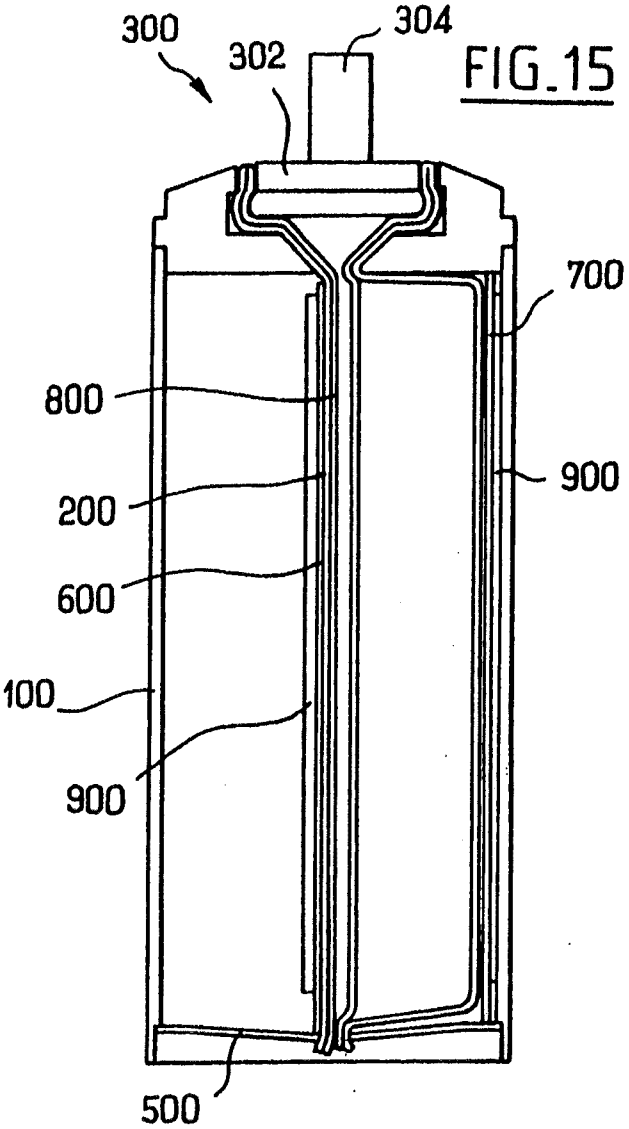
FIG. 15 represents an axial sectional view of dispenser device in accordance with the present invention, more precisely the left half-view of FIG. 15 represents the device in the empty state, whilst the right half-view of FIG. 15 represents the same device in the full state.

The container body 100 can form the subject of numerous embodiments. It may be formed for example from a solid-walled cylinder such as represented in FIGS. 13 and 15, axisymmetric or not about its central axis 102. The container body 100 can for example have a polygonal cross-section looked at in a plane transverse to the aforesaid axis 102. The body 100 preferably has a constant cross-section throughout its length. The body 100 can be formed from any appropriate material, such as for example plastic or else metal, especially iron, aluminum, or even cardboard or glass.

Figure 16:
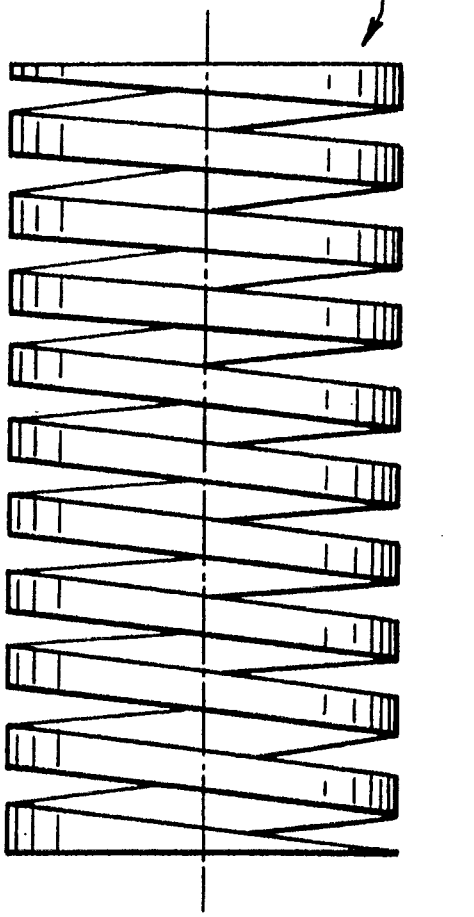
FIG. 16 represents a container body in accordance with a variant embodiment of the present invention.

As a variant, as represented in FIG. 16, the body 100 may be formed from a simple helical spring centered on the axis 102.

As will be seen in what follows, the body 100 serves as radial expansion limiter for the receptacle 200.

The receptacle 200 may be formed from a blind pouch as described in the aforesaid documents EP-A-0 300 886 or EP-A-0 383 270.

However, preferably, in the context of the present invention the receptacle 200 is formed from an extruded elastic tube. The use of an extruded tube represents, by comparison with a blind pouch as described in the documents EP-A-0 300 886 and EP-A-0 383 270, a major economy in tooling, the replacing of molds by extrusion dies and the possibility for limitless adaptation of the length of the receptacle. Furthermore, the use of an extruded tube makes it possible, as will be made clear in what follows, after dismantling the dispenser, to rinse and sterilize the receptacle/tube 200, for example with a flux of steam followed by sterile hot air.

The extruded receptacle 200 is advantageously made of butyl rubber.

The dispensing head 300 can be formed from any appropriate structure known to those skilled in the art. It advantageously comprises a housing 302 which accommodates a valve loaded by a spring against an associated seat and a control button 304 which can be actuated by a user in order to separate the said valve from its seat and thus free a through passage so as to permit substance dispensing. Preferably, the housing 302 is furnished, on its outer periphery, with an annular bead facilitating fixing of the dispensing head to the dome 400.

The dome 400 can likewise form the subject of numerous embodiments. It may be formed from metal or plastic.

Preferably, the dome 400 is formed from a single part whose external right cross-section is identical to that of the body 100. The dome advantageously has an annular recess 402 on its external surface to allow the dome 400 to be fitted to an axial end of the body 100.

The dome 400 has a chamber 406 which is complementary to the housing 302 of the head 300 and which emerges onto its upper surface 408. The dome 400 is furthermore crossed by a passage 410, preferably in the shape of a slot, which connects the lower surface 412 of the dome with the said chamber 410. As represented in FIG. 4, the passage 410 advantageously has inclined chamfers 414 on the side of the chamber 406.

The passage 410 is intended to receive the upper end of the receptacle 200 and of the elongation limiter 800 whilst allowing through the material to be dispensed.

The bottom wall 500 is intended to be placed against the bottom of the body 100. It is moreover adapted in order to be fixed to the lower end of the receptacle 200.

The bottom wall 500 can form the subject of numerous embodiments adapted for this purpose.

Preferably, the bottom wall 500 comprises a clasp structure adapted to be clamped to the lower end of the receptacle 200 so as to fix the latter and simultaneously ensure the leaktightness of the receptacle 200.

A preferred exemplary embodiment of such a bottom wall 500 has been represented in FIGS. 6 to 9. According to the embodiment of FIGS. 6 to 9, the bottom wall 500 comprises a disc 502 which is generally plane when unstressed and which has a cutout 504 through its thickness, in the general shape of an H. The web 506 of the cutout 504 is made along a diameter of the disc 502. The two flanges 508 of the cutout 504 which are situated respectively on either side of the web are symmetrical with respect to the diametral plane containing the web 506. These flanges 508 converge towards their free end. Two fold lines 510 which are parallel to one another and parallel to the web 506 and which respectively connect the free ends of the flanges 508 are moreover provided.

The structure 500 thus formed is made from an elastic material, for example metal or plastic.

In order to fix the bottom wall 500 to the lower end of the receptacle 200 and of the elongation limiter 800 it is sufficient to deform the two flaps 512 delimited by the cutout 504, on the same side of the plane of the disc 502, thus making it possible to separate the internal diametral edges of the said flaps 512, as represented in FIGS. 7 and 9, to introduce the lower end of the receptacle 200 and of the elongation limiter 800 into the gap thus formed between the two flaps 512 and to release the latter. It is understood that the receptacle 200 and the elongation limiter 800 are thus clasped between the flaps 512. Moreover, any traction on the receptacle 200, for example under the effect of the latter's internal pressure, magnifies the clamping and hence leaktightness.

The spring plates 600 and 700 are identical in structure. They are placed respectively on either side of the receptacle 200 and preferably bear upon the internal surface of the body, in order to operate on the receptacle 200 a constant pressure able to permit delivery of the substance contained in the receptacle 200, when the dispensing head 300 is open.

These plates 600 and 700 can be in accordance with the provisions described in documents EP-A-0 300 886 and EP-A-0 383 270. These plates 600 and 700 are thus formed preferably from spring steel plates with a thickness of a few tenths of a millimeter and with a rectangular outline.

The elongation limiter 800 is intended to limit the separation between the dome 400 and the bottom wall 500, in particular when filling the receptacle 200. The elongation limiter 800 is therefore formed from a non-elastic element so that this limiter is not capable of lengthening. However, preferably, the elongation limiter 800 is made from a flexible material. The elongation limiter 800 can thus be formed for example on the basis of a metal or plastic.

The elongation limiter 800 can form the subject of numerous embodiments. It can be formed for example from a simple strip accommodated in the receptacle 200 in order to be fixed both to the dome 400 with the upper end of the receptacle 200 and to the bottom wall 500 with the lower end of the receptacle 200.

However, as represented in the attached figures, the elongation limiter 800 is preferably formed from a plastic tube, for example polyethylene, accommodated in the receptacle 200. In this case, the tube forming the elongation limiter 800 is clasped at its upper end between the dome 400 and the housing 302 of the dispensing head 300, and at its lower end in the bottom wall 500. Consequently, so as not to disturb passage of the material to be dispensed, during the opening of the head 300, the tube 800 must be furnished with at least one passage through its thickness.

Figure 10:
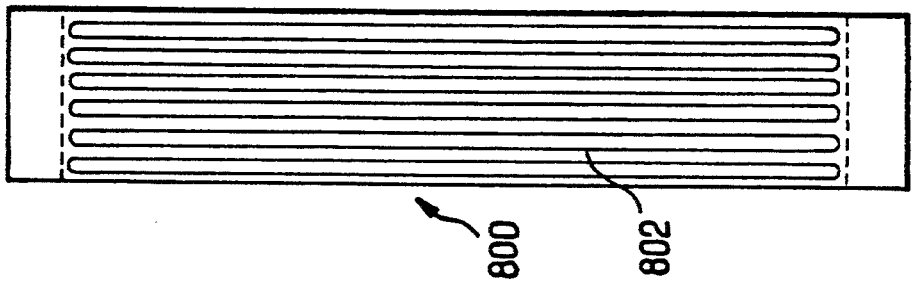
FIG. 10 represents a side view of an elongation limiter in accordance with the present invention.
Figure 11:
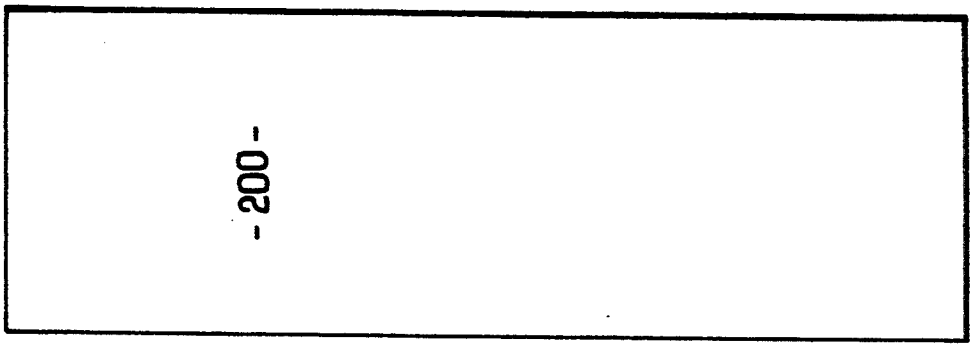
FIG. 11 represents a side view of a receptacle in accordance with the present invention.
Figure 12:
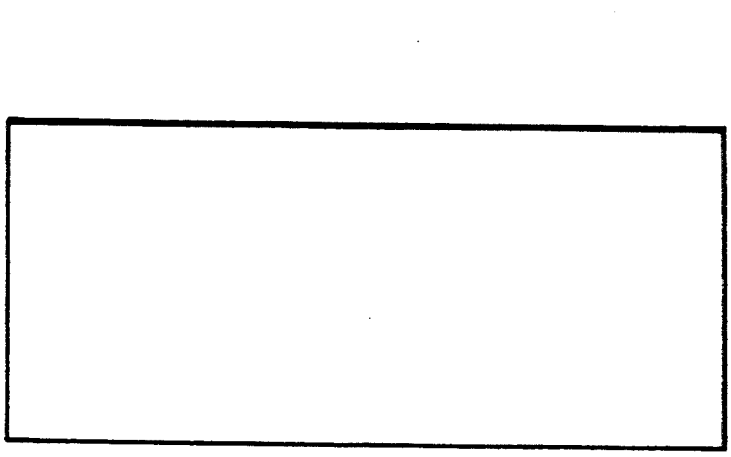
FIG. 12 represents a side view of an elastic plate in accordance with the present invention.

According to the first embodiment represented in FIG. 10, the tube 800 is provided with a plurality of longitudinal slits 802 which extend substantially throughout the length of the tube, with the exception of crowns situated at the upper and lower ends of the tube 800, where the latter is to be clasped respectively between the dome 400 and the housing 302 and in the bottom wall 500.

Figure 14:
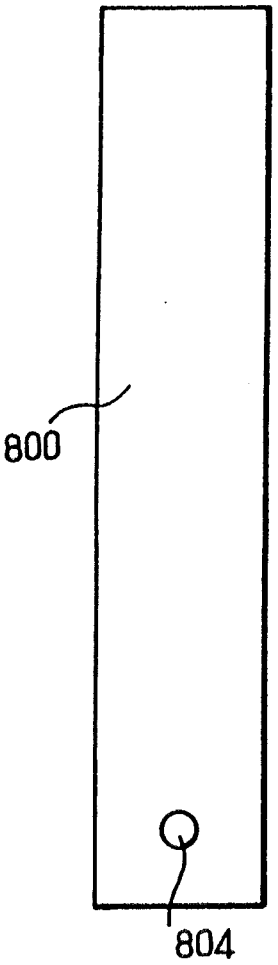
FIG. 14 represents a side view of an elongation limiter in accordance with the present invention.

By contrast, according to the second embodiment represented in FIG. 14, the tube 800 comprises a single through orifice 804, in the vicinity of its lower end. This second embodiment is adapted to be used in the case of dispensing a substance containing, as a mixture, a propellant gas, so that the gas confined in the upper portion of the receptacle 200 cannot pass directly into the dispensing head 300, whilst on the contrary permitting passage of the substance through the lower orifice 804.

If appropriate the dispenser device can be supplemented with a shrouding cap clipped into the bottom of the body 100. For this purpose, in order to facilitate the fixing of the cap, the body 100 is preferably provided at its lower end with a recess 104 complementary with the said cap.

In order to assemble the dispenser device it is expedient to proceed as follows.

Firstly, the elongation limiter 800 is placed in the receptacle 200. The upper end of the receptacle 200 and of the elongation limiter 800 is placed in the slot 410 in the dome 400 and immobilized in the latter by fitting the housing 302 into the chamber 406. The fixing of the head 300 into the dome 400 can be achieved with any appropriate conventional means, for example by flanging the dome 400 onto the housing 302, as is known per se. Plates 600 and 700 are then placed respectively on either side of the receptacle 200. Preferably an elastic sheath 900 is furthermore stretched over the plates 600 and 700. The unit thus formed is then placed inside the body 100, the base of the dome 400 being fitted into the upper end of the body 100. The lower end of the receptacle 200 and of the elongation limiter 800 is next clasped in the bottom wall 500 placed at the lower end of the body 100, according to the procedure described earlier. The operational device represented in FIG. 15 is then obtained.

The dome 400 and the bottom wall are connected by the elongation limiter 800.

When filling the receptacle 200, the body 100 limits the radial expansion of this receptacle.

In order to dismantle the device, it is sufficient to separate the two flaps 512 in order to free the receptacle 200 and the elongation limiter 800. If necessary, any worn-out or broken part can therefore readily be changed.

In order to facilitate this deforming of the flaps 512, perforations 520 can preferably be provided in these flaps 512 in order to allow hooks to be fitted into them.

Preferably, it is desirable to prop up the dome 400 and the bottom wall 500 when filling the receptacle 200 so as to prop up the elongation limiter 800 as the pressure rises.

As indicated earlier, the radial expansion limiter for the receptacle can be formed advantageously from a helical spring 100 as represented in FIG. 16. This technique has obvious economic advantages by comparison with the use of an external housing formed from a continuous-walled cylinder, since the use of a spring 100 allows different diameters and entails only fairly simple tooling modifications with lengths on request, culminating in a unit cost which is several times lower than a cylinder of whatever material.

Furthermore, in the case of the use of a spring 100, the storage of the radial expansion limiter is limited to wire coils. Winding machines are inexpensive and compact and make it possible to go from high to very low series with insignificant cost modifications.

If appropriate, the spring 100 can be covered with a heat-shrinkable sleeve. It is in particular possible to use dispenser devices comprising, as external housing, such a spring 100 covered, as appropriate, with a heat-shrinkable sleeve for bottom of the range products, especially for use in communal settings, such as hospitals.

Furthermore, it is possible to provide for packaging the dispenser device comprising the receptacle 200, the dispensing head 300, the dome 400, a radial expansion limiter formed from a spring 100, the bottom wall 500 and preferably the elastic plates 600, 700 and the sheath 900 in the form of a refill adapted to be introduced into a more or less lavish over-housing which is kept by the consumer, similar to the housing 100 represented in the attached Figures. Once empty, the return of the said refill to a packager may be envisaged with a view to filling anew.

It will also be noted that the elasticity of the spring 100 protects the dispenser device against shocks during multiple transportation.

Of course, the present invention is not limited to the embodiments which have just been described but extends to all variants in accordance with the spirit thereof.

Thus for example, although according to the preferred embodiment described earlier, the device comprises two loading plates 600 and 700 and a sheath 900, these elements can, if appropriate, be omitted, if the intrinsic elasticity of the receptacle 200 allows, or even used in combination with a propellant gas. The use of loading plates 600 and 700 can for example be combined with the use of a gas/substance to be dispensed mixture, especially if the gas used is so merely in small quantity and has merely a diluent role.

We claim:

1. Dispenser device of the type comprising:

a container body having first and second axial ends, and an insert provided in said container body, said insert including, a receptacle having first and second axial ends made from an elastic material and which contains the substance to be dispensed, a dispensing head fixed on said receptacle first axial end, which communicates with an inner portion of said receptacle and which can be opened and closed on command, a bottom wall fixed on said receptacle second axial end, an elongation limiter comprised of a non-elastic unitary element located in said inner portion of said receptacle and fixed between the dispensing head, and the bottom wall in order to limit the separation between said dispensing head and said bottom wall, means for removably fixing said dispensing head and said first axial end of the receptacle on the first axial end of the container body, and means for removably fixing said bottom wall and said second axial end of the receptacle on the second axial end of the container body.

2. Device according to claim 1, wherein the receptacle is formed from an extruded tube.

3. Device according to claim 1, wherein the elongation limiter is formed from a flexible material.

4. Device according to claim 1, wherein the elongation limiter is formed from a flexible strip.

5. Device according to claim 1, wherein the elongation limiter comprises a tube including at least one perforation.

6. Device according to claim 5, wherein said at least one perforation comprises plural longitudinal slits.

7. Device according to claim 5, wherein said at least one perforation comprises a perforation in the vicinity of a lower end of said tube.

8. Device according to claim 1, wherein the elongation limiter is made from polyethylene.

9. Device according to claim 1, wherein the bottom wall comprises a clasp.

10. Device according to claim 1, wherein the bottom wall is formed from a disc comprising a generally H-shaped cutout through a thickness of said disc.

11. Device according to claim 10, wherein said cutout comprises a central web and lateral flanges, said web lies along a diameter of the disc, whilst the flanges converge towards their free ends.

12. Device according to claim 10, wherein the bottom wall further comprises passages able to receive hooks.

13. Device according to claim 1, further comprising two elastic plates placed respectively on either side of the receptacle.

14. Device according to claim 13, further comprising an elastic sheath stretched over the elastic plates.

15. Device according to claim 1, wherein said container body comprises a radial expansion limiter.

16. Device according to claim 15, wherein the radial expansion limiter is formed from a helical spring.

17. Device according to claim 16, further comprising a heat-shrinkable sleeve placed over the spring.

18. Device according to claim 1, wherein the elongation limiter comprises a metal strip.

19. Device according to claim 1, wherein the container body comprises a helical spring.

20. Device according to claim 1, wherein the container body comprises a helical spring covered by a heat shrinkable sleeve.

21. Device according to claim 1, wherein the container body further comprises a helical spring provided on the outside of said receptacle so as to limit radial expansion of said receptacle.

22. Dispenser device comprising:

a container body having first and second axial ends, an insert provided in said container body and including a receptacle made from an elastic extruded tube having first and second axial ends, and which contains the substance to be dispensed, a dispensing head tightly fixed on said first axial end of the receptacle, which communicates with the inside of the receptacle and which can be opened and closed on command, a bottom wall tightly fixed on said second axial end of the receptacle which is opposite the dispensing head, an elongation limiter made from a unitary non-elastic element provided inside said receptacle and fixed to the dispensing head and to the bottom wall in order to limit the separation between said dispensing head and said bottom wall, means for removably fixing said dispensing head and said first axial end of the receptacle on the first axial end of the container body, and means for removably fixing said bottom wall and said second axial end of the receptacle on the second axial end of the container body.

23. Dispenser device comprising:

a container body having first and second axial ends, an insert provided in said container body and including a receptacle having first and second axial ends, made from an elastic material and which contains the substance to be dispensed, a dispensing head fixed on said first axial end of the receptacle, which communicates with the inside of the receptacle and which can be opened and closed on command, a bottom wall fixed on said second axial end of the receptacle which is opposite the dispensing head, an elongation limiter made from a unitary non-elastic strip provided inside said receptacle and fixed to the dispensing head and to the bottom wall in order to limit the separation between said dispensing head and said bottom wall, means for removably fixing said dispensing head and said first axial end of the receptacle on the first axial end of the container body, and means for removably fixing said bottom wall and said second axial end of the receptacle on the second axial end of the container body.

24. Device according to claim 23, wherein the elongation limiter comprises a metal strip.

25. Dispenser device comprising:

a container body having first and second axial ends, an insert provided in said container body and including a receptacle having first and second axial ends, made from an elastic material and which contains the substance to be dispensed, a dispensing head fixed on said first axial end of the receptacle, which communicates with the inside of the receptacle and which can be opened and closed on command, a bottom wall fixed on said second axial end of the receptacle which is opposite the dispensing head, an elongation limiter made from a unitary non-elastic element provided inside said receptacle and fixed to the dispensing head and to the bottom wall in order to limit the separation between said dispensing head and said bottom wall, urging means provided outside said receptacle for exerting a permanent pressure on said receptacle so as to dispense the substance when the dispensing head is opened, means for removably fixing said dispensing head and said first axial end of the receptacle on the first axial end of the container body, and means for removably fixing said bottom wall and said second axial end of the receptacle on the second axial end of the container body.

26. A device according to claim 25, wherein the urging means comprises two elastic plates placed respectively on opposite sides of the receptacle and an elastic sheath stretched over said plates.

27. Dispenser device comprising:

a container body having first and second axial ends, an insert provided in said container body and including a receptacle made from an elastic extruded tube having first and second axial ends and which contains the substance to be dispensed, a dispensing head fixed on said first axial end of the receptacle, which communicates with the receptacle and which can be opened and closed on command, a bottom wall fixed on said second axial end of the receptacle which is opposite the dispensing head, an elongation limiter made from a unitary non-elastic metal strip provided inside said receptacle and fixed to the dispensing head and to the bottom wall in order to limit the separation between said dispensing head and said bottom wall, urging means comprising two elastic plates placed respectively on opposite sides of the receptacle and an elastic sheath stretched on said plates, for exerting a permanent pressure on said receptacle so as to dispense the substance when the dispensing head is opened, means for removably fixing said dispensing head and said first axial end of the receptacle on the first axial end of the container body, and means for removably fixing said bottom wall and said second axial end of the receptacle on the second axial end of the container body.

* * * * *